US010006676B2

(12) United States Patent
Kraus et al.

(10) Patent No.: US 10,006,676 B2
(45) Date of Patent: Jun. 26, 2018

(54) TEMPERATURE CONTROL DEVICE

(71) Applicant: HYDAC COOLING GMBH, Sulzbach/Saar (DE)

(72) Inventors: Artur Kraus, Augsburg (DE); Juergen Hof, Augsburg (DE)

(73) Assignee: HYDAC COOLING GMBH, Sulzbach/Saar (DE)

( * ) Notice: Subject to any disclaimer, the term of this patent is extended or adjusted under 35 U.S.C. 154(b) by 164 days.

(21) Appl. No.: 14/913,705

(22) PCT Filed: Sep. 4, 2014

(86) PCT No.: PCT/EP2014/002397

§ 371 (c)(1),
(2) Date: Feb. 23, 2016

(87) PCT Pub. No.: WO2015/036106

PCT Pub. Date: Mar. 19, 2015

(65) Prior Publication Data

US 2016/0209086 A1 Jul. 21, 2016

(30) Foreign Application Priority Data

Sep. 11, 2013 (DE) ..... 10 2013 015 368

(51) Int. Cl.
*G05D 23/00* (2006.01)
*F25B 25/00* (2006.01)
(Continued)

(52) U.S. Cl.
CPC ..... *F25B 25/00* (2013.01); *F25B 25/005* (2013.01); *F25B 41/003* (2013.01); *F25B 41/04* (2013.01); *F25D 17/02* (2013.01)

(58) Field of Classification Search
CPC ..... F25B 25/00; F25B 25/005; F25B 41/003; F25B 41/04; F25B 41/02; F04B 23/023;
(Continued)

(56) References Cited

U.S. PATENT DOCUMENTS 3,635,286 A * 1/1972 Dubsek ..... F04D 7/065 165/104.31
5,970,729 A 10/1999 Yamamoto et al.
(Continued)

FOREIGN PATENT DOCUMENTS

DE 29 44 273 5/1981
DE 37 14 771 12/1988
(Continued)

OTHER PUBLICATIONS

International Search Report (ISA) dated Jan. 26, 2015 in International (PCT) Application No. PCT/EP2014/002397.

*Primary Examiner* — Travis Ruby
(74) *Attorney, Agent, or Firm* — Wenderoth, Lind & Ponack, L.L.P.

(57) ABSTRACT

A temperature control device has a flow line (15) for supplying a consumer, connected to the flow line (15), with a liquid medium at a predetermined temperature. A return line (17) is connected to the consumer for returning at least one part of the liquid medium from the consumer to a mixing device (41). In a predefinable ratio, the liquid medium of the return line (17) is mixed in the mixing device with a storage medium provided in a tank (25). The mixing device has a mixing chamber (41) arranged below the filling level of the tank (25) with the storage medium.

13 Claims, 2 Drawing Sheets

(51) Int. Cl.
*F25D 17/02* (2006.01)
*F25B 41/00* (2006.01)
*F25B 41/04* (2006.01)

(58) Field of Classification Search
CPC ..... F04B 23/021; F04B 23/026; F04B 23/02; F04B 39/06; F04B 53/08
See application file for complete search history.

(56) References Cited

U.S. PATENT DOCUMENTS

2004/0144528 A1* 7/2004 Kunimoto ..... F24D 17/02 165/298
2007/0267188 A1* 11/2007 Di Stefano ..... G05D 23/1393 165/296

FOREIGN PATENT DOCUMENTS

| | | |
|---|---|---|
| DE | 299 21 647 | 3/2000 |
| DE | 10 2004 041 252 | 3/2006 |
| EP | 0 069 172 | 1/1983 |
| EP | 0 861 747 | 9/1998 |
| EP | 0 922 916 | 6/1999 |

* cited by examiner

TEMPERATURE CONTROL DEVICE

FIELD OF THE INVENTION

The invention relates to a tempering device, having a feed line for supplying a load, connectable to the feed line, with a fluid medium, having a preselectable temperature, and having a return line, connectable to the load, for returning at least a portion of the fluid medium from the load to a mixing device. In the mixing device, the fluid medium of the return line is mixed with a supply medium stored in a tank at a preselectable volume ratio.

BACKGROUND OF THE INVENTION

Tempering devices of this type represent the prior art. These devices operating using mixing valve technology are frequently used for tempering coolants, such as water/glycol mixtures, for example, for spindle cooling in machine tools, for cooling switch cabinets or hydrostatic drives, for cooling or tempering tasks in the printing industry, in laser technology, medical technology, and the like. Another field of application relates to the cooling of hydraulic fluids, for example, in connection with hydrostatic drives. In these systems operating using mixer valve technology, portions of the medium flowing back from the load in the return line pass through a 3/2-way valve in volumes dependent on demand for cooling capacity to reach a heat exchanger. The heat exchanger is in heat exchange with the evaporator of a cooling unit, and from there into the tank. A circulating pump, the pressure delivery side of which is connected to the feed line, sucks fluid medium from the tank and mixes it by a mixing device with the remaining medium, flowing back via the return line.

SUMMARY OF THE INVENTION

An object of the invention is to provide an improved tempering device of the described type that is characterized by particularly favorable operational behavior.

According to the invention, this object is basically provided by a tempering device having, as an essential feature of the invention, a mixing device having at least one mixing chamber. During operation of the tempering device, the mixing chamber is arranged below the filling level of the tank containing the supply medium. The installation of a mixing chamber submerged in the tank enables targeted distribution of heat with high energy efficiency. In addition, it results in a reduced need for external piping.

In particularly advantageous exemplary embodiments, the mixing device with its mixing chamber forms components of a submersible pump that is at least partially arranged in the tank with its suction side below the filling level and with its pressure delivery side, which leads to the feed line, preferably arranged above the filling level in the tank. The design of the circulation pump as a submersible pump arranged in the tank permits an increase in operational reliability in a particularly advantageous manner. While in the prior art the circulation pump is provided as a dry mounted horizontal pump, the sealless submersible pump avoids the susceptibility to malfunctions associated with horizontal pumps with mechanical seals, which are affected by fluid media containing, for example, ethylene or glycol. The direct installation of the mixing chamber on the submersible pump furthermore results in a particularly reduced need for piping.

In particularly advantageous exemplary embodiments, the mixing chamber has at least one connection opening in the immersion pump housing, which opens into the storage volume of the tank. The mixing device, as part of the return line, has at least one connecting line, leading from a distributor device to the mixing chamber. The distributor device can be formed by a 3/2-way valve that divides the return flow, depending on demand for cooling capacity, into a volume flow flowing through the connecting line and a volume flow flowing through the heat exchanger of the cooling unit and into the storage tank.

The distributor device can be controlled by a control device, which, depending on the temperature of the medium of the feed line, passes at least a portion of the fluid medium of the return line to a cooling device, such as the heat exchanger of the cooling unit, and passes the other remaining portion to the mixing chamber.

Advantageously, the cooling device has a compressor cooling system. The cooled fluid medium of the return line is passed into the tank.

In particularly advantageous exemplary embodiments, the compressor cooling system has a separate cooling circuit with a refrigerant. The refrigerant flows through a heat exchanger, through which, at the same time, at least the portion of the fluid medium of the return flow to be cooled is passed. In a particularly advantageous manner, the heat exchanger can hereby be provided in the form of a plate heat exchanger, forming a functional unit with the evaporator of the compressor cooling system.

The compressor cooling system may have at least one condenser and one compressor, as well as a drying device, which is arranged in the cooling circuit upstream from the evaporator associated with the heat exchanger.

In particularly advantageous exemplary embodiments, the control device has a temperature controller that controls a motor control valve to divide the fluid medium into a portion to be cooled by the cooling device and a portion that is fed into the mixing chamber. The motor control valve, for example in the form of a 3/2-way valve, is controlled by the temperature controller depending on the feed line temperature measured by a temperature sensor. Depending on the signal from the temperature sensor, the compressor cooling system has to operate only when cold fluid medium is required in the storage tank. The required cooling capacity can then be adapted to the demand, thereby achieving high energy efficiency. Due to the adaptable cooling capacity, the desired temperature of the medium in the feed line can be set very accurately to desired values with tolerances that are less than +/−0.3K.

Particularly advantageously, the arrangement can be made so that several submersible pumps, preferably with different pump capacities, are arranged in the tank such that, depending on the submersible pumps put into operation, different feed line temperatures for the fluid medium and/or different delivery rates for the feed line fluid medium can be achieved. This arrangement allows for a particularly energy-saving, demand-oriented adjustment.

With particular advantage, the tank may be provided with a fluid guide in its storage volume for a homogenized supply of the fluid to be mixed in the mixing chamber, in particular for tempering devices constructed in accordance with the invention. Such fluid guide may be formed by chamber walls arranged in the tank, which walls form a type of labyrinth for the flow path in the tank.

In particular for tempering devices formed in accordance with the invention, the arrangement may be further made such that, in order to achieve homogeneous tempering of the control device, the control device, in particular in the form of power electronics, rests flat against a tank wall of the tank and preferably is at least partially integrated into the outer housing of the tank. This arrangement achieves simultaneous tempering/cooling of the control device in a simple and advantageous manner.

Other objects, advantages and salient features of the present invention will become apparent from the following detailed description, which, taken in conjunction with the drawings, discloses a preferred embodiment of the present invention.

BRIEF DESCRIPTION OF THE DRAWINGS

Referring to the drawings that form a part of this disclosure.

DETAILED DESCRIPTION OF THE INVENTION

Figure 1:
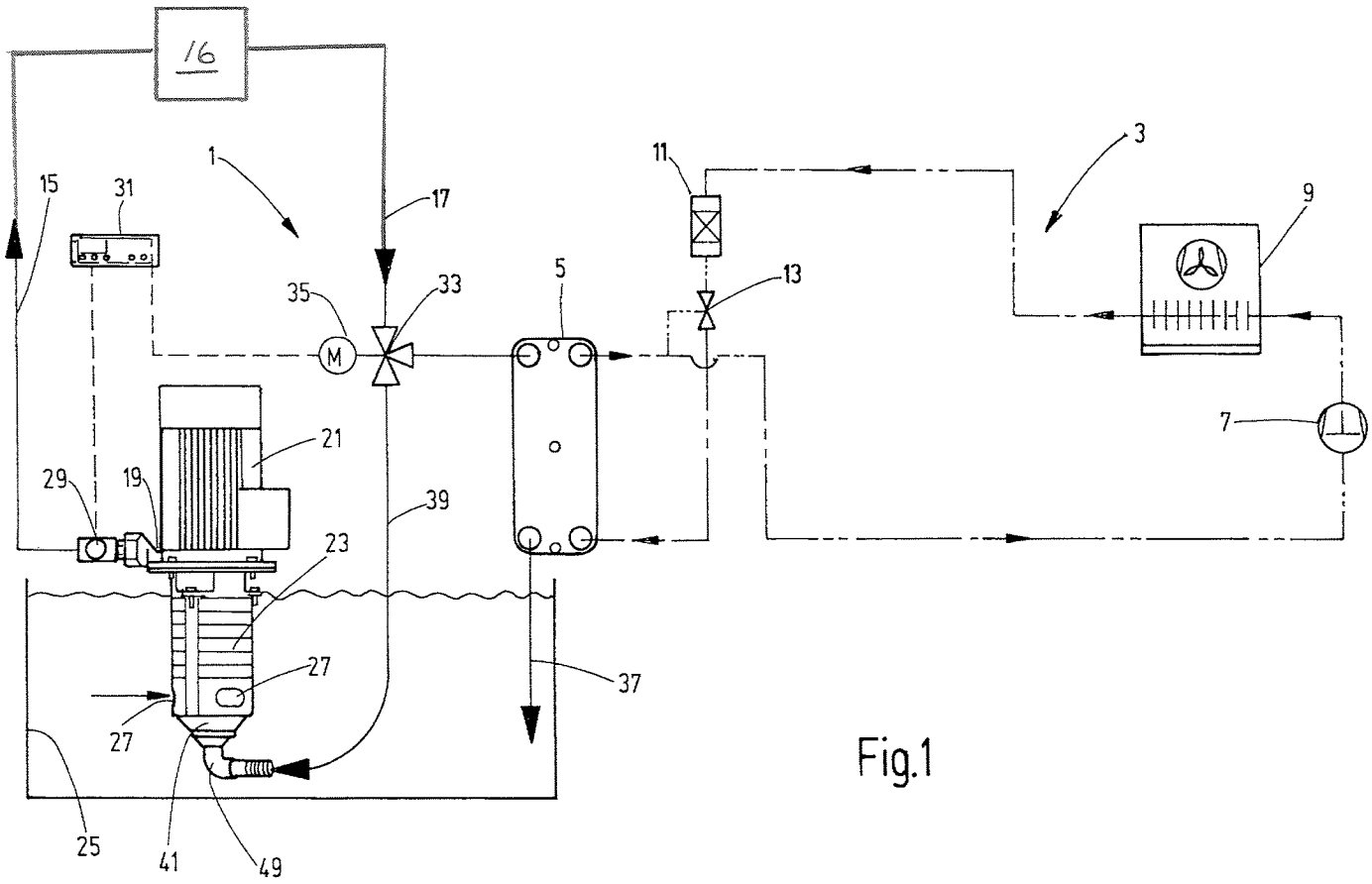
FIG. 1 is a schematic diagram, partly drawn as a symbolic representation, of a tempering device according to an exemplary embodiment of the invention.

In FIG. 1, the functional diagram of the exemplary embodiment of the tempering device according to the invention shows a load circuit 1 and a cooling circuit 3. The interface between the circuits 1 and 3 is formed by a plate heat exchanger 5. The primary side of the heat exchanger, which side is associated with the load circuit 1, is transversable by fluid medium of the load cycle 1 to be cooled. The secondary side of the plate heat exchanger 5 forms the evaporator for the cooling circuit 3 formed by a compressor cooling unit. As is conventional, the cooling circuit 3 has a compressor 7, drivable by an electric motor. The suction side of compressor 7 is connected to the secondary side of the plate heat exchanger 5, serving as an evaporator. The pressure side of compressor 7 is connected to a condenser 9. The refrigerant passes through a drying device or dryer 11 and to an expansion valve 13 and, from there, to the secondary side of the plate heat exchanger 5, forming the evaporator.

In the load circuit 1, the feed line 15 leads to the load or consumer 16. The return line 17 provides back from the load. For the supply of the corresponding fluid medium to the load, the feed line 15 is connected to the pressure delivery side 19 of a circulation pump operable by an electric motor 21. In the tempering device according to the invention, the circulating pump is formed by a submersible pump 23. It is installed in a storage tank 25 such that fluid inlet openings 27 of the suction side of the submersible pump 23 are below the filling level of the tank 25. The pressure delivery side 19 of the submersible pump 23 is above the filling level of the storage tank 25. At the junction of the pressure delivery side 19 with the feed line 15, a temperature sensor 29 is arranged, which supplies a temperature controller 31 with a signal representing the feed line temperature.

The fluid medium flowing back from the load, such as coolant, for example water with added glycol or ethylene, or hydraulic oil, flows from the return line 17 to a distributor device formed by a 3/2-way valve 33 in the present example. Valve 33 is designed as a motor control valve controllable by the temperature controller 31 by a servo motor 35 as a function of the temperature measured by the sensor 29. Acting as a distributor device, the control valve 33 divides the fluid medium flowing through return line 17 into a portion flowing through the primary side of the plate heat exchanger 5 into the storage tank 25 (see flow arrow 37) and into a portion flowing through a connecting line 39 into a mixing chamber 41. If the sensor 29 indicates low demand for cooling capacity or no demand for cooling capacity, the portion flowing through the heat exchanger 5 is low or zero based on the setting of the control valve 33, while a correspondingly larger portion flows through the connecting line 39 into the mixing chamber 41.

Figure 2:
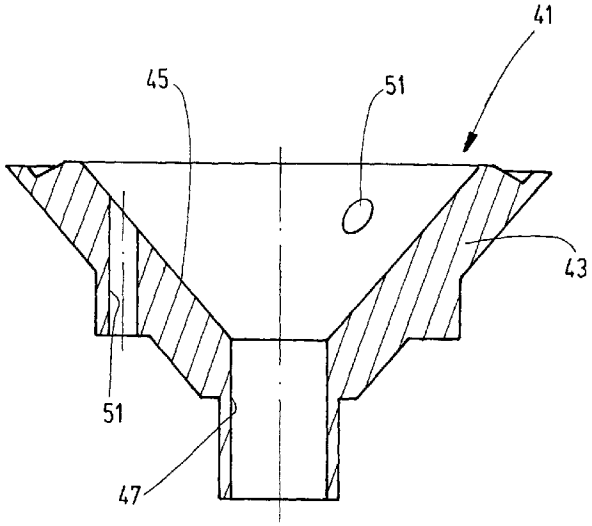
FIG. 2 is a life-size side view in section of a practical embodiment of the mixing chamber of the exemplary embodiment of FIG. 1.

In the tempering device according to the invention, the mixing chamber 41, which is shown separately in FIG. 2, is formed by a housing component of the pump housing of the submersible pump 23. The mixing chamber 41 is located at the suction end of the pump housing of the submersible pump 23, and therefore, is below the filling level of the storage tank 25 during operation. As shown particularly in FIG. 2, the mixing chamber 41 forms a housing end cover 43 on the suction end of the housing of the submersible pump 23, so that the mixing chamber 41 is below the filling level of the storage tank 25 during operation. As shown in FIG. 2, the cover 43 has the shape of a cone with an inner funnel 45, which forms the wall of the mixing chamber 41. At the lower funnel opening 47, as shown in FIG. 1, a connection elbow 49 is mounted. The connecting line 39 is connected to the funnel opening 47. The housing cover 43 forming the mixing chamber 41 has screw holes 51 for connection bolts for flange mounting the cover 43 to the pump housing.

The portion of the medium flowing back through the return line 17, which has no cooling requirement, passes through the connecting line 39 directly into the mixing chamber 41 and is mixed with the remaining portion, i.e., with the cooled medium flowing through the heat exchanger 5 into the tank 25, inside the mixing chamber 41 in the suction area of the submersible pump 23. If there is no demand for cooling capacity, the entire amount of the return line 17 flows through the connecting line 39 into the suction side of the submersible pump 23. If there is demand for cooling capacity, a correspondingly larger portion flows through the plate heat exchanger 5 into the tank 25, from which a corresponding portion is sucked in through the inlet openings 27 of the suction side of the submersible pump 23 and mixed with the remaining portion from the connecting line 39.

Advantageously, the compressor 7 of the compressor cooling system operates only when the storage tank 25 requires cold medium. The required cooling capacity can then be adapted to the demand, thereby achieving maximum energy efficiency. In applications where different set values of the feed line temperature may result and/or different delivery rates for the feed line fluid medium may be required, multiple submersible pumps 23 can be provided in the tank 25, which pumps can selectively be put into operation. Advantageously, these may be submersible pumps 23 with different pump capacities.

Figure 3:
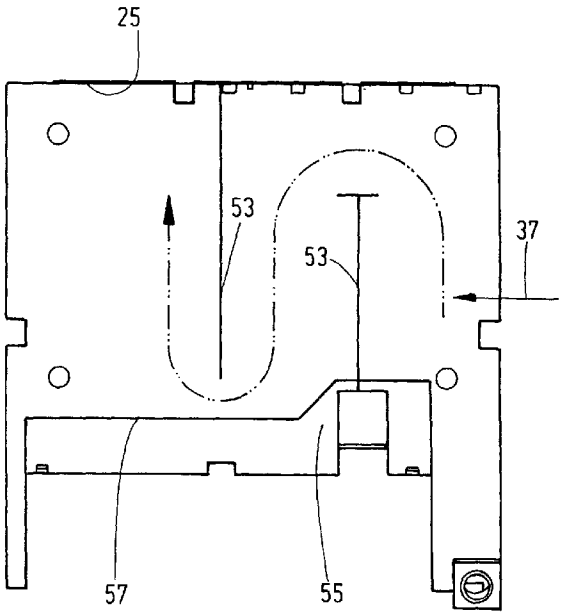
FIG. 3 is a side view in section of the fluid storage tank of the exemplary embodiment of FIG. 1 on a smaller scale.

In order to homogenize the temperature distribution within the medium in the tank 25 for an optimal mixing process inside the mixing chamber 41, a fluid-guide, which is designed so that a homogenized supply of medium to be mixed runs through the inlet openings 27 of the submersible pump 23, may be provided in a particularly advantageous manner within the storage volume of the tank. The tank is constructed such that a homogenized supply of medium to be mixed runs through the inlet openings 27 of the submersible pump 23. For this purpose, as shown in FIG. 3, a type of labyrinth may be formed by chamber walls 53 within the tank 25, forming a winding flow path for the medium cooled in the plate heat exchanger 5, which medium flows in as indicated by arrow 37.

Particularly advantageously, in tempering devices operating using mixer valve technology and having a corresponding storage tank, that is, for tempering devices constructed according to the invention, the tank 25 may simultaneously perform the function of tempering the associated control device for integrated cooling of the temperature controller 31, having, for example, power electronics. For this purpose, a receiving space 55 may be formed on the outer housing of the tank 25, which forms a contact surface 57 on the tank wall for flat contact of the corresponding power electronics. The contact surface 57 forms a heat exchange surface.

While one embodiment has been chosen to illustrate the invention, it will be understood by those skilled in the art that various changes and modifications can be made therein without departing from the scope of the invention as defined in the claims.

The invention claimed is:

1. A tempering device, comprising:

a feed line connected to a load to supply a fluid medium having a preselectable temperature to said load;

a return line connected to said load to return at least a portion of the fluid medium from said load;

a mixer connected in fluid communication to said feed line, said mixer being connected in a tank in fluid communication and mixing a supply medium stored in said tank with the fluid medium conveyed through said return line to said mixer at a predetermined volume ratio of the fluid medium conveyed through said return line to said mixer to said supply medium, said mixer having a mixing chamber arranged below a filling level of said supply medium in said tank during operation of the tampering device;

a cooler connected in fluid communication with said tank;

a distributor valve selectively connecting in fluid communication via connecting lines, said return line to said mixing chamber and said return line to said cooler; and a control connected to said distributor valve passing at least one portion of the fluid medium conveyed in said return line to said mixing chamber and a remaining portion of the fluid medium conveyed in said return to said cooler and subsequently to said mixing chamber via said tank depending on temperature of the fluid medium conveyed through said feed line.

2. The tempering device according to claim 1 wherein said mixer and said mixing chamber therein are components of a submersible pump arranged at least partially in said tank, said submersible pump having a suction side below the filling level and having a pressure delivery side leading to said feed line, said pressure delivery side being arranged above the filling level in said tank.

3. The tempering device according to claim 1 wherein said mixing chamber comprises at least one connection opening in an immersion pump housing, said connecting opening into a storage volume of said tank.

4. The tempering device according to claim 1 wherein said cooler comprises a compressor cooling system.

5. The tempering device according to claim 4 wherein said compressor cooling system comprises a separate cooling circuit with a refrigerant flowing through a heat exchanger forming said cooler at a same time the remaining portion of the fluid medium passes through said heat exchanger to be cooled.

6. The tempering device according to claim 4 wherein said compressor cooling system comprises a condenser, a compressor and a dryer.

7. The tempering device according to claim 1 wherein said control device comprises a temperature controller; and said distributor valve comprises a motor control valve connected to and controlled by said temperature controller.

8. A tempering device according to claim 1 wherein said mixer comprises plural submersible pumps arranged in said tank such that at least one of different feed line temperatures for the fluid medium or different delivery rates or different delivery values for the fluid medium in said feed line are achievable.

9. The tempering device according to claim 8 wherein said submersible pumps have different pump capacities.

10. The tempering device according to claim 1 wherein a fluid guide is in a storage volume of said tank providing a homogenized supply of the supply medium to be mixed in said mixing chamber.

11. The tempering device according to claim 1 wherein said control rests flat against a tank wall of said tank.

12. The tempering device according to claim 11 wherein said control comprises power electronics.

13. The tempering device according to claim 11 wherein said control is at least partially integrated into an outer housing of said tank.

* * * * *